US005430533A

United States Patent [19]

Dreyfuss et al.

[11] Patent Number: 5,430,533

[45] Date of Patent: Jul. 4, 1995

[54] POLYMERIC TONER TRANSFER MEMBER MATERIAL

[75] Inventors: David D. Dreyfuss, Versailles; Todd L. Janes, Lexington; Alexander D. Meade, Lexington; Jeanne M. Saldanha-Singh, Lexington; Peter E. Wallin, Lexington, all of Ky.

[73] Assignee: Lexmark International, Inc., Greenwich, Conn.

[21] Appl. No.: 251,768

[22] Filed: May 31, 1994

[51] Int. Cl.[6] ..... G03G 13/16

[52] U.S. Cl. ..... 355/273; 428/447; 430/126

[58] Field of Search ..... 355/271, 273, 274; 430/126; 428/425.8, 447, 451, 450, 448, 449, 373

[56] References Cited

U.S. PATENT DOCUMENTS

| | | | |
|---|---|---|---|
| 3,957,367 | 5/1976 | Goel | 355/271 X |
| 5,028,964 | 7/1991 | Landa et al. | 355/273 |
| 5,084,735 | 1/1992 | Rimai et al. | 355/271 |

*Primary Examiner*—A. T. Grimley
*Assistant Examiner*—Nestor R. Ramirez
*Attorney, Agent, or Firm*—John A. Brady

[57] ABSTRACT

An electrophotographic printer employs a intermediate transfer roller of a copolymer of urethane and silicone carbinol. Transfer efficiency is excellent over a period normally coinciding with the full life of a printer or other imaging device.

1 Claim, No Drawings

POLYMERIC TONER TRANSFER MEMBER MATERIAL

TECHNICAL FIELD

This invention relates to electrostatic imaging. More specifically, this invention relates to a surface material for an intermediate member from which a electrostatically toned image is transferred with high efficiency and for extended periods.

BACKGROUND OF THE INVENTION

In certain electrostatic imaging systems, particularly where full color images are produced, transfer of a toned image from an intermediate member is a technical barrier. This is especially the case where the developer is a liquid toner, since then the surface of the intermediate member must be resistant to the chemical effects of the liquid of the toner.

In such color systems the intermediate image is formed on the intermediate member by successive transfer from the surface of a photoconductor member of images in plural colors, typically the primary subtractive colors of magenta, cyan, and yellow. These three images, and often a fourth image of black, are layered on top of each other on the intermediate member to achieve a full color image in the final size to be transferred to paper or other final substrate. This invention is directed to achieving substantially complete transfer of such image over a long operative life of the imaging apparatus. Material selection for the intermediate transfer member is critical to such performance. The material must have very specific electrical and surface properties which cannot change over time or with use. The two principle materials that function best are silicones and polyurethanes. Polyurethanes have excellent abrasion resistance for long life and easily tailored electrical properties so that they will function in electrostatic transfer from the photoconductive roller. However, they also have high surface energy which causes the toner to bond to the intermediate transfer member during second transfer to paper, which is achieved by heat and pressure and electrical bias toward the paper.

In contrast, silicones have very low surface energy which facilitates 100 percent transfer of toner to paper. There are several limitation of silicone. One is that it has very high inherent electrical resistivity that is not easily modified. Second is that it has low abrasion resistance which is further reduced when the silicones is exposed to the toner carrier fluid, such as a heavy mineral oil. Thus, the electrical resistivity of silicones requires that they can only be used in thin layers, but such thin layer wear away quickly.

Mixtures of silicone and other resins are previously known. U.S. Pat. No. 3,957,367 to Goel is illustrative. A polymer of urethane and silicone is not shown in such known prior art. U.S. Pat. No. 5,084,735 to Rimai et. al. teaches other release materials in an intermediate transfer member.

DISCLOSURE OF THE INVENTION

In accordance with this invention an intermediate transfer member in an imaging apparatus has a surface of a copolymer of polydimethyisiloxane (silicone) and polyurethane. The combination of these materials at the molecular level provides a unique set of properties which allow a transfer roller to function for extended periods. This invention has particular applicability to liquid electrophotographic systems, but may be used in any system which requires a roller or belt surface to accept toner electrostatically and release it to paper by thermal or electrostatic means.

BEST MODE FOR CARRYING OUT THE INVENTION

The reaction of a polyisocyanate and a polyalcohol to form polyurethane is shown below. The urethane linkage is what gives polyurethane its excellent abrasion resistance, tear resistance and toughness.

The reaction to polyurethane:

$$\mathrm{OCN{-}R1{-}NCO + HO{-}R2{-}OH} \longrightarrow \mathrm{OCN{-}R1{-}\overset{H}{\overset{|}{N}}{-}\overset{O}{\overset{\|}{C}}{-}O{-}R2{-}OH}$$

The R1 group, which is the polyisocyanate, is supplied commercially by a number of vendors. The preferred embodiment used Vibrathane 8011, a trademark from of Uniroyal Chemical Company. The R2 group, which is the polyalcohol, is typically a polyetheralcohol or polyesteralcohol. The preferred embodiment uses Voranol 234-630, a trademark product of Dow Chemical Company.

This invention creates a copolymer of urethane and silicone by employing an organo-functional silicone, specifically silicone polycarbinol, or alcohol functional polydimethylsiloxane to partially or fully replace the polyether or polyester alcohol in the foregoing polyurethane, to thereby achieve a molecule containing silicone cured into the backbone of the polyurethane polymer. The preferred embodiment used Q4-3667, a trademark product of Dow Corning Company. This results in a copolymer which has surface energy of silicone, and electrical properties and abrasion resistance of polyurethane. A suitable filler, such as cesium iodide, is added to control the resistivity.

The preferred embodiment formulation is a follows:

| Material | Amount by Weight |
|---|---|
| Vibrathane 8011 polyisocyanate | 100.0 |
| Voranol polyetheralcohol | 6.550 |
| Q4-3667 silicone carbinol | 8.000 |
| Conductive filler (cesium iodide) | 0.003 |

Copolymerization is spontaneous with stirring. The resulting copolymer is diluted with 2-butanone and spray or dip coated on to the outer layer of a polyurethane roller or belt to form a finished intermediate transfer member with the transfer surface of the foregoing filled copolymer.

Functionality with respect to the foregoing copolymer can be considered the number of OH (hydroxyl,) groups per molecule. Equivalent weight is a measure of the size of the molecule to which the OH groups are attached and is related to molecular weight. The Q4-3667 silicone carbinol results from polyethylene glycol to provide in the final material an average of two OH groups per molecule, which is a functionality of 2. Hardness of polyurethanes is governed by the isocyanate percentage, the functionality of the polyalcohol and the equivalent weight of the polyalcohol. Voranol 234-630 polyether alcohol has a functionality of 3 and an equ 630. Q4-3667 silicone carbinol has a low functionality of 2 and a high equivalent weight of 1200. The Q4-3667 silicone carbinol therefore makes the coating softer.

Durometer of the material resulting from the cure of the foregoing polyisocyanate and the foregoing polyetheralcohol results in a measurement of 50A. The full foregoing formula produces a material of a reading of 40A, a 20 percent reduction in hardness. Softness is important in transfer to rough surfaces such a paper.

In the foregoing embodiment some polyether alcohol was used because of the low percent of isocyanate (NCO) groups in the molecule (3.27 percent by weight). When using Mondur MR, trademark product of Miles Corp., a polyisocyanate with 31 percent by weight isocyanate groups, the silicone polycarbinol can be fully substituted for the polyeyetheralcohol.

A mixture of 80 percent by weight polyurethane and 20 percent by weight silicone was used as the surface layer of an intermediate transfer roller. Although initially thoroughly mixed, this mixture segregated into a heterogeneous morphology of pockets of silicone in a polyurethane matrix. Additionally, a small amount of silicone migrated to the surface and created a very thin layer of pure silicone that was only detectable by ESCA analysis. The pockets of silicone were visible in a optical microscope but the surface layer was not. This thin layer of silicone wore away within 1000 pages of ordinary operation in a liquid toner electrophotographic printer, leaving the intermediate transfer member unable to transfer to paper.

A pure silicone layer is not formed with the foregoing preferred copolymer. Also, infrared analysis shows that the silicon carbinol was cured into the backbone of the polymer. Non-hydroxyl-functional silicone oil was incorporated into the polyetheralcohol at equal parts per hundred as the silicon carbinol and also with the silicon carbinol, the remainder being as described for the preferred embodiment. An attempt was made on the final product to extract the silicone material with chloroform. The silicone oil having no hydroxyl was completely removed while most of the silicon carbinol remained.

An intermediate transfer member in the form of a roller with the preferred embodiment coating was stressed in a life test robot for 108,000 pages. The toner was a liquid toner have a heavy mineral oil vehicle. Transfer was from a photoconductor roller to the intermediate transfer roller with electrostatic attraction to the transfer roller and then to paper with a backup roller with heat and pressure, as well as an electrostatic attraction from the backup roller. The transfer roller was removed periodically to perform a print test and measure surface and electrical properties. The transfer roller still transferred toner acceptably at the end of the test and no appreciable change in the surface roughness or surface energy was observed. This demonstrated that this coating provides excellent functionality in transferring from 97 percent to 100 percent of toner, the range depending upon factors extraneous to this invention, and is applicable as coating for any roller or belt in a transfer configuration which requires the controlled balance of mechanical, surface, and electrical properties.

The Q4-3667 silicone carbinol is known primarily as a lubricant for synthetic fiber processing. It is also promoted as an additive for polyurethane and other polymers. Variation within the spirit and scope of this invention can be anticipated.

What is claimed is:

1. A method of electrophotographic imaging comprising creating an electrostatic image on a photosensitive member, toning said image with an electrostatic toner, transferring said toned image to an intermediate transfer member, and transferring said toned image from said intermediate transfer member to paper, characterized by the surface of said intermediate transfer member being a copolymer of urethane and silicone carbinol.

* * * * *